US009060613B2

(12) United States Patent
Combs

(10) Patent No.: US 9,060,613 B2
(45) Date of Patent: Jun. 23, 2015

(54) PERSONAL WEATHER SHELTER

(76) Inventor: Oscar Combs, Houston, TX (US)

( * ) Notice: Subject to any disclaimer, the term of this patent is extended or adjusted under 35 U.S.C. 154(b) by 541 days.

(21) Appl. No.: 13/302,493

(22) Filed: Nov. 22, 2011

(65) Prior Publication Data

US 2013/0127213 A1 May 23, 2013

(51) Int. Cl.

| | |
|---|---|
| ***A47C 29/00*** | (2006.01) |
| ***A47C 7/66*** | (2006.01) |
| ***A47C 7/02*** | (2006.01) |

(52) U.S. Cl.

CPC .. *A47C 7/66* (2013.01); *A47C 7/021* (2013.01)

(58) Field of Classification Search

USPC ..... 297/184.1, 184.11, 184.15, 252, 352, 297/184.16, 184.17; 135/900

See application file for complete search history.

(56) References Cited

U.S. PATENT DOCUMENTS

| | | | | | |
|---|---|---|---|---|---|
| 309,451 | A | * | 12/1884 | Ford | 135/114 |
| 2,014,614 | A | * | 9/1935 | Czygan | 297/184.15 |
| 2,037,945 | A | * | 4/1936 | Stockil | 297/18 |
| 2,070,484 | A | * | 2/1937 | Jones | 135/151 |
| 2,137,312 | A | * | 11/1938 | Thompson | 297/252 |
| 2,414,298 | A | * | 1/1947 | Haich | 297/20 |
| 2,505,702 | A | * | 4/1950 | Benjamin | 297/28 |
| 2,752,929 | A | * | 7/1956 | Berger | 297/31 |
| 2,841,207 | A | * | 7/1958 | Sweeney | 297/252 |
| 2,926,724 | A | * | 3/1960 | Rittenberg | 297/40 |
| 3,066,980 | A | * | 12/1962 | Clute | 297/252 |
| 3,155,427 | A | * | 11/1964 | Necessary | 297/184.14 |
| 3,343,869 | A | * | 9/1967 | Scheinwald | 297/16.1 |
| 3,404,915 | A | * | 10/1968 | De Souza Filho | 297/17 |
| 3,994,529 | A | * | 11/1976 | Lippert | 297/252 |
| 4,100,633 | A | * | 7/1978 | Pintos | 5/418 |
| 4,112,957 | A | * | 9/1978 | Biven | 135/87 |
| 4,230,363 | A | * | 10/1980 | Borichevsky | 297/184.15 |
| 4,355,650 | A | | 10/1982 | Beaudry | |
| 4,611,852 | A | * | 9/1986 | Filer | 297/352 |
| 5,096,257 | A | * | 3/1992 | Clark | 297/184.15 |
| 5,255,954 | A | * | 10/1993 | Rogers | 297/184.16 |
| 5,553,914 | A | * | 9/1996 | Holladay | 297/184.17 |
| 5,582,458 | A | * | 12/1996 | Wildt | 297/184.15 |
| 5,695,100 | A | * | 12/1997 | O'Brien | 224/160 |
| 5,797,650 | A | * | 8/1998 | Gonzalez et al. | 297/184.1 |
| 5,921,258 | A | * | 7/1999 | Francois | 135/88.03 |
| 5,951,103 | A | * | 9/1999 | Barnhill | 297/248 |

(Continued)

OTHER PUBLICATIONS http://www.silverandblueoutfitters.com/store/Hardback-Stadium-Seat.html.

*Primary Examiner* — Laurie Cranmer

(74) *Attorney, Agent, or Firm* — Law Office of Shannon Warren, PLLC; Shannon L. Warren

(57) ABSTRACT

A personal weather shelter is disclosed comprising a seat portion, a shelter portion, one or more arms, one or more screw assemblies, and one or more rotating assemblies. Said seat portion comprises a base, a seat back, a front, a back, a first side, a second side, a top and a bottom. Said arms each comprise a first end and a second end. Said first ends of said arms each attach to said seat portion with said screw assembly and are each capable of rotating on said screw assemblies relative to said seat portion. Said shelter portion is capable of attaching and rotating relative to said second ends of each of said arms with said rotating assemblies. Said personal weather shelter is capable of transitioning between an open configuration and a closed configuration by rotating arms about screw assemblies and shelter portion about rotating assemblies.

16 Claims, 15 Drawing Sheets

(56) References Cited

U.S. PATENT DOCUMENTS

| | | | | |
|---|---|---|---|---|
| 5,967,601 | A * | 10/1999 | Gillins | 297/184.15 |
| 6,244,286 | B1 * | 6/2001 | Russo | 135/128 |
| 6,296,002 | B1 * | 10/2001 | Tashchyan | 135/96 |
| 6,352,306 | B1 * | 3/2002 | Dreiling | 297/252 |
| 6,371,553 | B1 * | 4/2002 | Tang | 297/184.1 |
| 6,405,742 | B1 * | 6/2002 | Driscoll | 135/96 |
| 6,711,769 | B1 * | 3/2004 | Jane-Prats | 5/639 |
| 6,789,557 | B1 * | 9/2004 | Wahl, Jr. | 135/154 |
| 6,979,056 | B1 * | 12/2005 | Goldszer | 297/184.15 |
| 7,118,172 | B1 * | 10/2006 | Pattison-Sheets | 297/129 |
| 7,140,678 | B1 * | 11/2006 | Grant | 297/184.15 |
| 7,243,990 | B1 * | 7/2007 | Wahl et al. | 297/184.15 |
| 7,374,238 | B2 * | 5/2008 | Lingwall | 297/184.11 |
| 7,475,939 | B1 * | 1/2009 | Hooker | 297/184.11 |
| 7,566,095 | B2 * | 7/2009 | Reeb et al. | 297/184.15 |
| 7,648,196 | B2 * | 1/2010 | Degelman et al. | 297/45 |
| 7,753,063 | B1 * | 7/2010 | Laws | 135/96 |
| 7,938,134 | B2 | 5/2011 | Adams | |
| 7,997,291 | B2 * | 8/2011 | Gressette et al. | 135/96 |
| 8,439,055 | B2 * | 5/2013 | April et al. | 135/16 |
| 2002/0112752 | A1 * | 8/2002 | Blakney | 135/96 |
| 2004/0226597 | A1 * | 11/2004 | McCampbell | 135/900 |
| 2006/0054207 | A1 * | 3/2006 | Wootliff | 135/96 |
| 2007/0040422 | A1 * | 2/2007 | Reeb et al. | 297/184.1 |
| 2008/0093902 | A1 * | 4/2008 | Jones | 297/252 |
| 2009/0218856 | A1 * | 9/2009 | Sykes et al. | 297/184.15 |
| 2010/0320820 | A1 * | 12/2010 | Vestweber | 297/252 |
| 2011/0163578 | A1 * | 7/2011 | Reeb et al. | 297/184.1 |
| 2012/0074740 | A1 * | 3/2012 | Reeb et al. | 297/184.1 |
| 2012/0261959 | A1 * | 10/2012 | Vestweber | 297/252 |
| 2013/0229034 | A1 * | 9/2013 | Quinn | 297/184.16 |

* cited by examiner

PERSONAL WEATHER SHELTER

BACKGROUND

This disclosure relates generally to a personal weather shelter.

Weather shelters are commonly used at spectator events but are usually limited to umbrellas and rain jackets. These technologies, however, require attention (in the case of an umbrella) to remain above a user and providing shelter to said user. Likewise, jackets may be uncomfortable and hot where conditions are not well suited to their use.

Other forms of weather shelters exist. For example, a tent is convenient when camping or standing on flat ground, but cannot be used in many spectator environments (such as a sports stadium).

Weather shelters designed for spectator environments are largely unusable due to limitations in material quality, structural defects and poor design.

None of the prior weather shelters, taken either singularly or in combination, are seen to describe the instant disclosure as claimed. Accordingly, an improved personal weather shelter would be advantageous.

SUMMARY

A personal weather shelter is disclosed. Said personal weather shelter comprising a seat portion, a shelter portion, one or more arms, one or more screw assemblies, and one or more rotating assemblies. Said seat portion comprises a base, a seat back, a front, a back, a first side, a second side, a top and a bottom. Said first side and said second side can each comprise a front end and a back end. Said arms each comprise a first end and a second end. Said first ends of said arms each attach to said seat portion with said screw assembly. Said arms are each capable of rotating on said screw assemblies relative to said seat portion. Said second ends of said arms each attach to said shelter portion with said rotating assemblies. Said shelter portion is capable of rotating on said rotating assemblies relative to said arms. Said personal weather shelter is capable of transitioning between an open configuration and a closed configuration by rotating arms about screw assemblies and shelter portion about rotating assemblies.

DETAILED DESCRIPTION

Described herein is a personal weather shelter. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
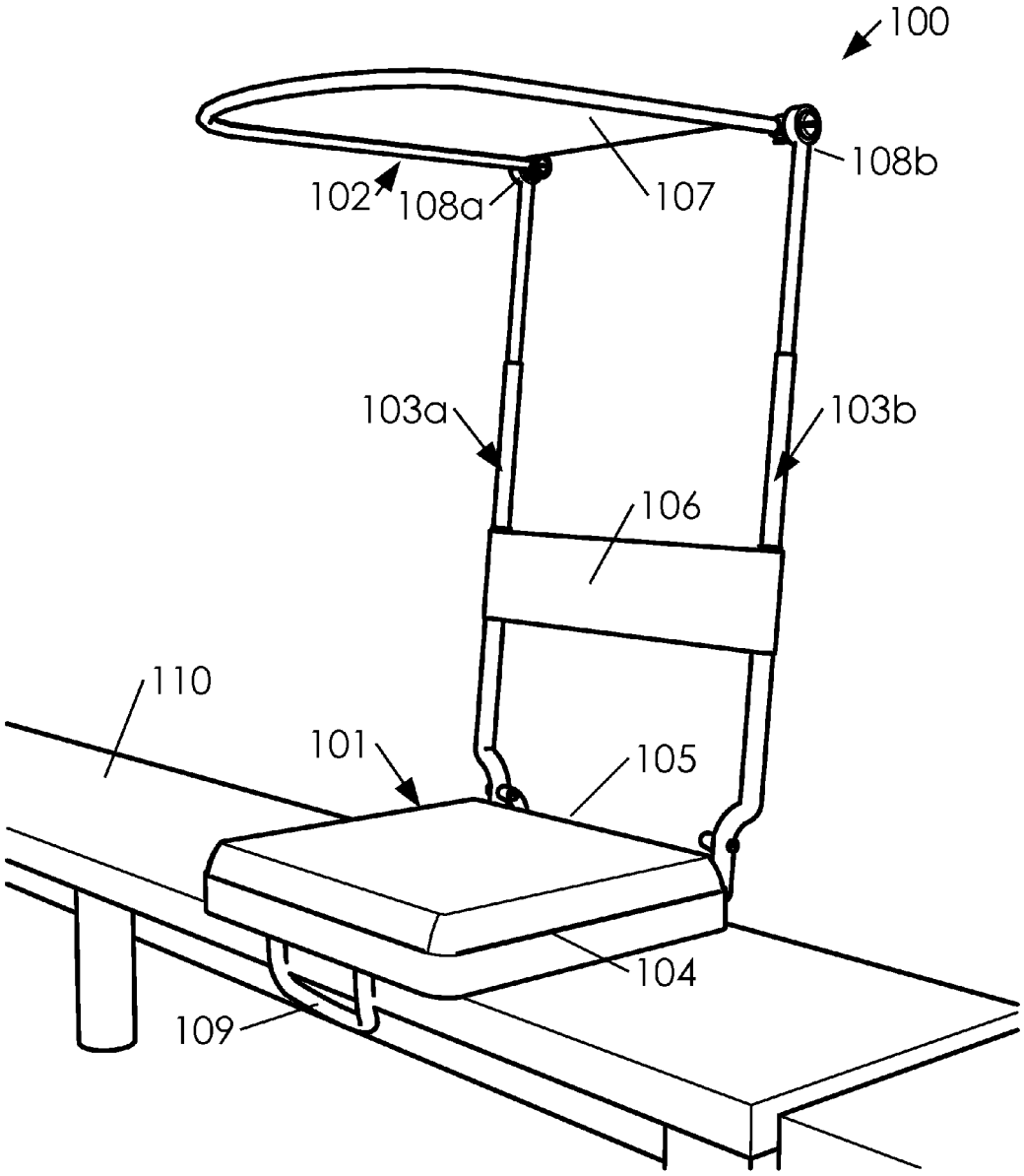
FIGS. 1A and 1B illustrate a first and second front perspective view of a personal weather shelter.
Figure 1B:
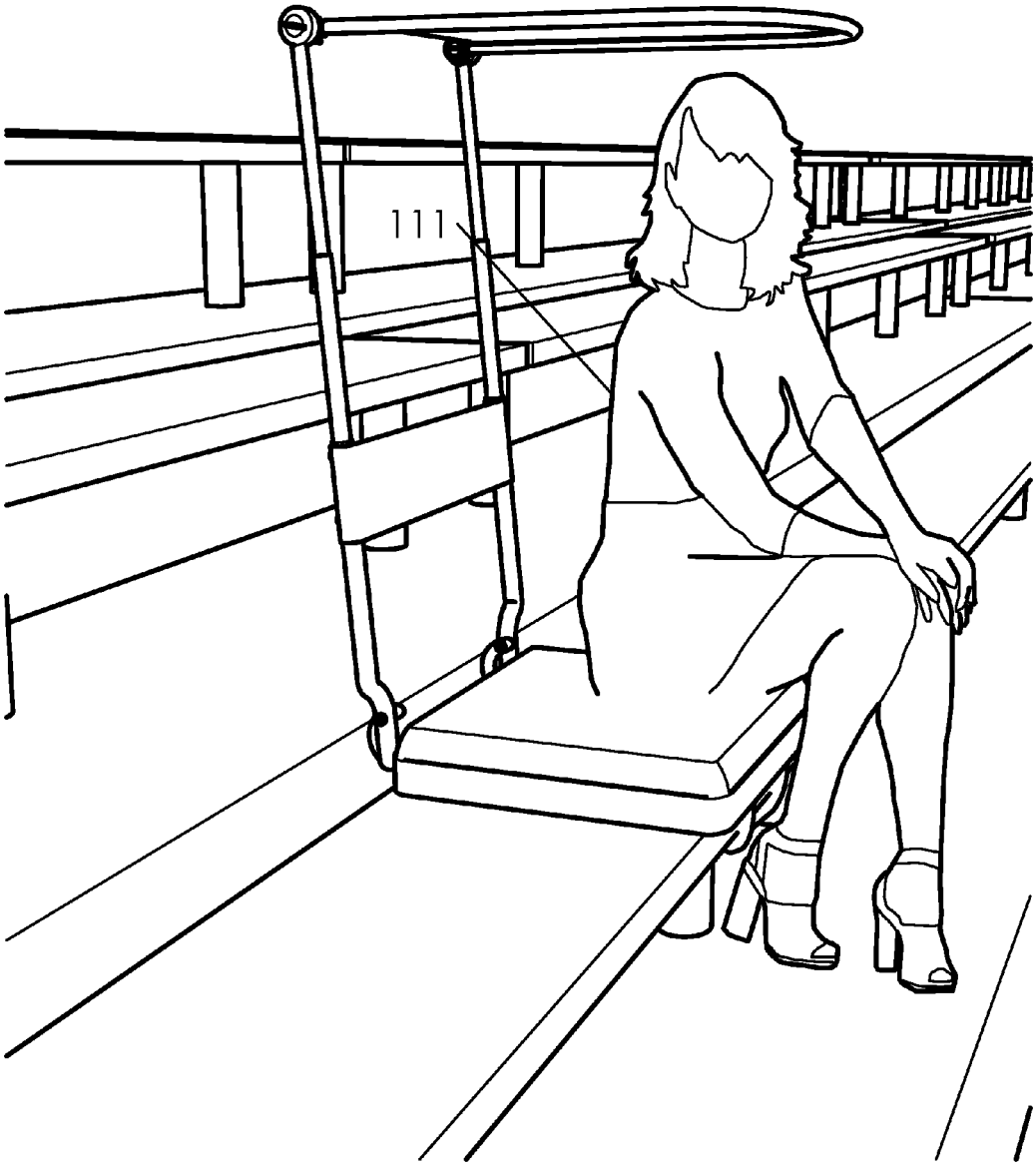

FIGS. 1A and 1B illustrate a first and second front perspective view of a personal weather shelter 100. Personal weather shelter 100 can comprise a seat portion 101, a shelter portion 102, and one or more arms 103. Arms 103 can comprise a first arm 103*a* and a second arm 103*b*. Seat portion 101 can comprise a base 104, a seat cushion 105, and a seat back 106. In one embodiment, base 104 can receive seat cushion 105. Shelter portion 102 can comprise a top 107 and one or more rotating assemblies 108. Rotating assemblies 108 can comprise a rotating assembly 108*a* and a rotating assembly 108*b*. Seat portion 101 can further comprise a grip 109. In one embodiment, personal weather shelter 100 can be used on a stadium bench 110. In one embodiment, base 104 is capable of stacking on stadium bench 110. In one embodiment, personal weather shelter 100 can support a user 111; wherein, user 111 can sit upon seat cushion 105 and lean against seat back 106. In one embodiment, grip 109 can hold personal weather shelter 100 on stadium bench 110 by wrapping around a front portion of stadium bench 110 to prevent personal weather shelter 100 from sliding off of stadium bench 110 when user 111 sits on personal weather shelter 100.

For this disclosure, a nomenclature (naming system) has been employed wherein numbers represent a part and a letter represents a side designation. Said side designation refers to a first side and a second side of personal weather shelter 100. Said first side has been represented by the letter "a" and said second side has been represented by the letter "b". So, for example, first arm 103*a* represents one of arms 103 on said first side and second arm 103*b* represents one of arms 103 on said second side.

Figure 2A:
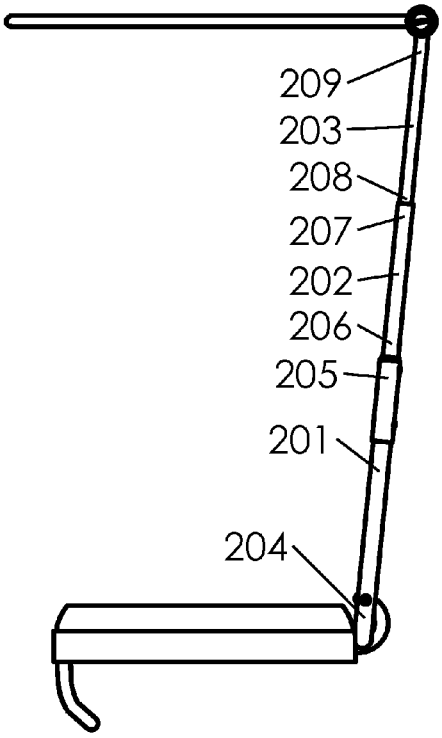
FIGS. 2A and 2B illustrate an elevated side view and an elevated back view of personal weather shelter.
Figure 2B:
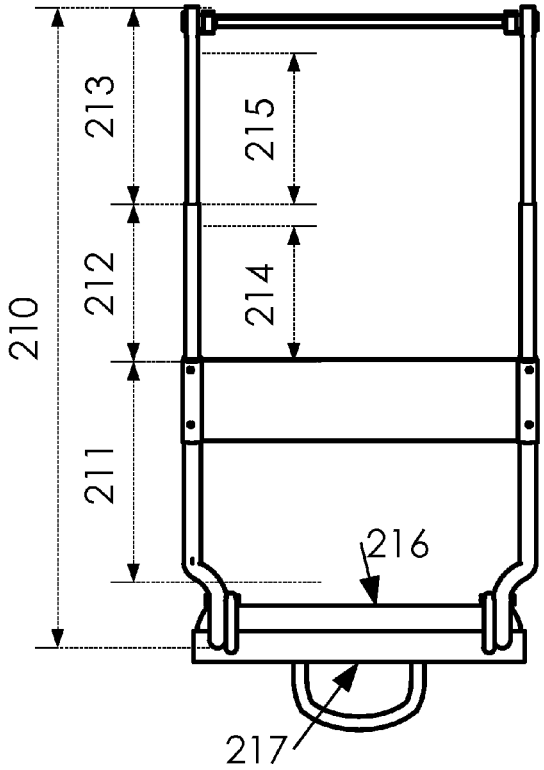

FIGS. 2A and 2B illustrate an elevated side view and an elevated back view of personal weather shelter 100. In one embodiment, arms 103 can comprise a plurality of telescoping portions capable of extending and contracting within one another. In one embodiment, each of arms 103 can comprise a first portion 201, a second portion 202, and a third portion 203. For example, in one embodiment, second arm 103*b* can comprise a first portion 201*b*, a second portion 202*b*, and a third portion 203*b*. Likewise, in one embodiment, first arm 103*a* can comprise a first portion 201*a*, a second portion 202*a*, and a third portion 203*a*. Each of first portions 201 can comprise a first end 204 and a second end 205. Each of second portion 202 can comprise a first end 206 and a second end 207. Each of 203 can comprise a first end 208 and a second end 209. In one embodiment, arms 103 can comprise a length 210. Length 210 can comprise a maximum length 210*a* and a minimum length 210*b*. In one embodiment, first portion 201 can comprise a length 211, second portion 202 can comprise a length 212, and/or third portion 203 can comprise a length 213. In one embodiment, a hidden portion 214 of second portion 202 can slide into first portion 201. In one embodiment, a hidden portion 215 of third portion 203 can slide into second portion 202. In one embodiment, seat portion 101 can comprise a top 216 and a bottom 217.

Figure 3:
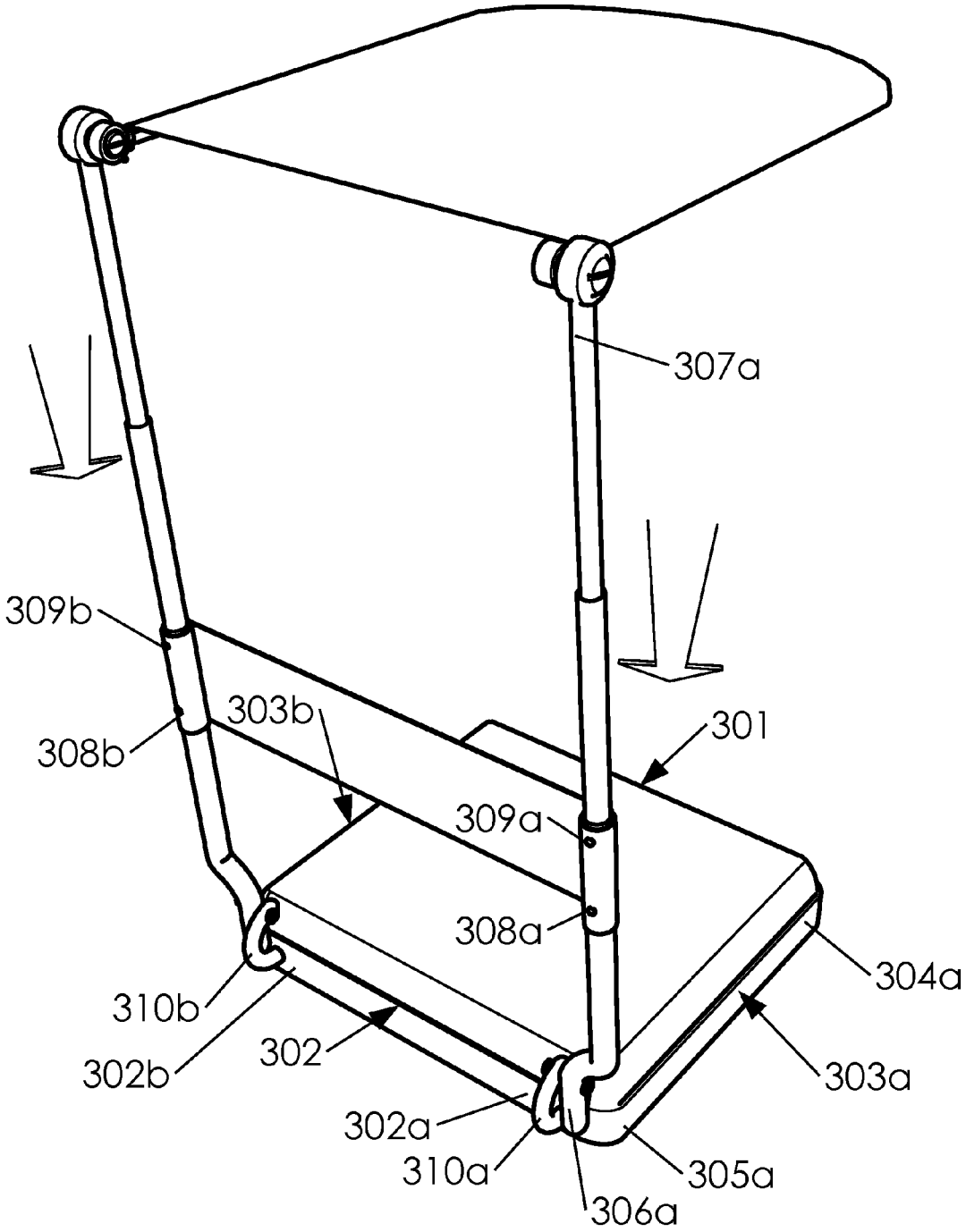
FIG. 3 illustrates a perspective rear view of personal weather shelter.

FIG. 3 illustrates a perspective rear view of personal weather shelter 100. In one embodiment, arms 103 can comprise a plurality of telescopic cylinders capable of extending from a contracted configuration to an extended configuration. In one embodiment, first portion 201, second portion 202, and third portion 203 can comprise said plurality of telescopic cylinders. In one embodiment, first portion 201 can comprise an external cylinder (or "main" cylinder), second portion 202 can slide in and out of first portion 201, and third portion 203 can slide in and out of second portion 202. In one embodiment, third portion 203 can comprise an internal cylinder (or "plunger") of said plurality of telescopic cylinders. In one embodiment, arms 103 can extend and contract based upon a length of first portion 201, second portion 202 and third portion 203 relative to one another. In one embodiment, arms 103 transition between said extended configuration and said contracted configuration by extending and contracting said plurality of telescopic cylinders. In one embodiment, said extended configuration can comprise first portion 201, second portion 202 and third portion 203 extending to maximum length 210*a*. In one embodiment, said contacted configuration can comprise first portion 201, second portion 202, and third portion 203 contracting to minimum length 210*b*. In one embodiment, said plurality of telescopic cylinders can comprise 2, 3, 4, 5, or more portions each. In one embodiment, like a spring loaded umbrella, said plurality of telescopic cylinders can further comprise an internal spring pressing said first portion 201 apart from third portion 203, a top spring and a bottom spring; wherein, said top spring can hold arms 103 in said extended configuration and said bottom spring can hold arms 103 in said contracted configuration.

In one embodiment, seat portion 101 can comprise a front 301, a back 302, a first side 303*a* and a second side 303*b*. Back 302 can comprise a first side 302*a* and a second side 302*b*. In one embodiment, each of first side 303*a* and second side 303*b* can comprise a front end 304 and a back end 305. First side 303*a* can comprise a front end 304*a* and a back end 305*a*. Second side 303*b* can comprise a front end 304*b* and a back end 305*b*.

Each of arms 103 can comprise a first end 306 and a second end 307.

In one embodiment, seat back 106 can attach between arms 103 with a plurality of pins. In one embodiment, said plurality of pins can comprise a first pin 308*a*, a first pin 308*b*, a second pin 309*a*, and a second pin 309*b*.

In one embodiment, each of arms 103 can attach to said seat portion 101 with a hinge extender 310. Hinge extender 310 can comprise a first extender 310*a* and a second extender 310*b*.

Figure 4A:
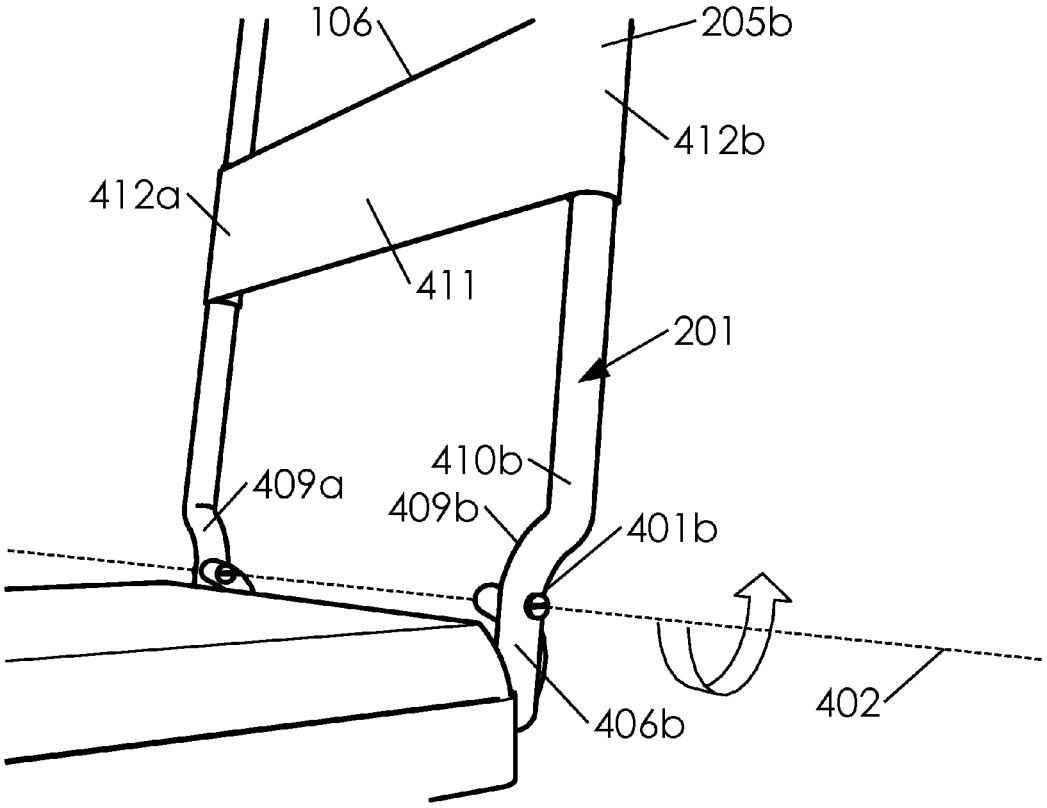
FIGS. 4A, 4B and 4C illustrate a second side perspective view, a second side elevated view and a rear elevated view of seat portion and arms.
Figure 4B:
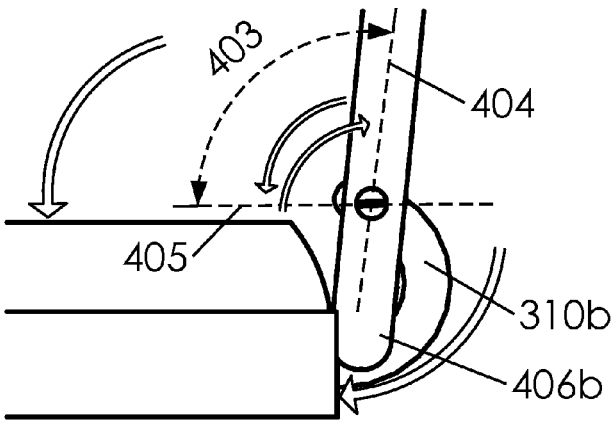
Figure 4C:
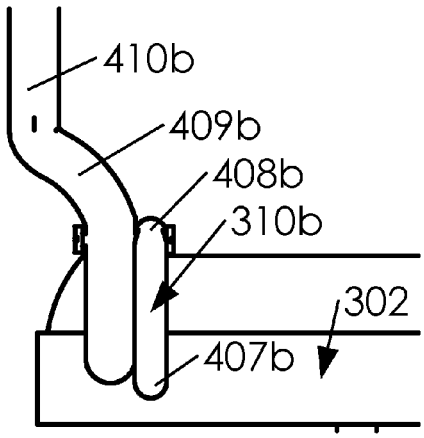

FIGS. 4A, 4B and 4C illustrate a second side perspective view, a second side elevated view and a rear elevated view of seat portion 101 and arms 103. In one embodiment, arms 103 with shelter portion 102 can fold to an open position and a closed position. In one embodiment, each first end 306 of arms 103 can attach to hinge extender 310 and hinge extender 310 can attach to back 302 of base 104. In one embodiment, each of first ends 306 can attach to hinge extender 310 with a screw assembly 401. In one embodiment, first arm 103*a* can attach to first side 302*a* with a first screw assembly 401*a*. In one embodiment, second arm 103*b* can attach to second side 302*b* with a second screw assembly 401*b*.

In one embodiment, each of arms 103 can rotate about a central axis 402 on screw assemblies 401. In one embodiment, arms 103 can rotate around central axis 402 through a range of positions 403. For example, in one embodiment, range of positions 403 can comprise an open position 404 and a closed position 405. In one embodiment, arms 103 can transition between open position 404 and closed position 405 by rotating about central axis 402 on screw assembly 401. In one embodiment, a lower portion 406 of first end 306 attaches below screw assembly 401; wherein, rotating arms 103 into open position 404 can comprise rotating arms 103 relative to seat portion 101 until lower portion 406 hits and presses against back 302. In one embodiment, rotating arms 103 into closed position 405 can comprise rotating arms 103 relative to seat portion 101 until a portion of arms 103 or seat back 106 hits and presses against seat portion 101. Thus, in one embodiment, personal weather shelter 100 has reached: open position 404 when lower portion 406 hits said back 302 and closed position 405 when a portion of arms 103 or seat back 106 hits said seat portion 101. In another embodiment, range of positions 403 can be limited by a limitation on rotary movement upon screw assembly 401.

In one embodiment, hinge extenders 310 can each comprise a substantially round cross-section and/or an overall arched shape. In one embodiment, hinge extender 310 can comprise a first end 407 and a second end 408. In one embodiment, first ends 407 of hinge extenders 310 can each attach to back 302 at first side 302*a* and second side 302*b*, respectively. In one embodiment, hinge extenders 310 can arch backward, up and then forward from first end 407 to second end 408. In one embodiment, arms 103 can each attach to second ends 408 of hinge extenders 310. In one embodiment, second ends 408 can be substantially rounded. In one embodiment, central axis 402 can be above and behind seat portion 101.

In one embodiment, first end 306 can comprise a substantially round cross-section. In one embodiment, each of first end 306 of arms 103 can comprise an elbow 409; wherein, each first portion 201 of arms 103 can comprise lower portion 406, elbow 409 and a straight portion 410. In one embodiment, straight portion 410 can receive second portion 202 in said plurality of telescoping portions. In one embodiment, starting with first end 204, first portion 201 can comprise lower portion 406 can comprise a substantially straight portion of first portion 201 extending substantially upward toward screw assembly 401, elbow 409 can comprise a bent portion of first portion 201 extending outward away from screw assembly 401 and upward, and first portion 201 can comprise a substantially straight portion of first portion 201 extending substantially upward. In one embodiment, lower portion 406, elbow 409 and straight portion 410 can comprise on piece of bent material. In another embodiment, lower portion 406, elbow 409, and straight portion 410 can comprise a plurality of pieces of material attached together by a bonding means, such as welding.

Seat back 106 can comprise a middle portion 411 and two end portions 412. End portions 412 can comprise a first end portion 412*a* and a second end portion 412*b*. In one embodiment, seat back 106 can be attached between first portions 201 of arms 103 by attaching end portions 412 to second ends 205. In one embodiment, end portions 412 can attach to second ends 205 by wrapping end portions 412 around second end 205 and securing end portions 412 with said plurality of pins; e.g., first end portion 412*a* can be secured with first pin 308*a* and second pin 309*a*, and second end portion 412*b* can be secured with first pin 308*b* and second pin 309*b*. In one embodiment, tension in middle portion 411 can provide back support to user 111 of personal weather shelter 100 by connecting end portions 412 to arms 103 with minimal slack in middle portion 411. In one embodiment, end portions 412 can attach to first portions 201 by wrapping and securing end portions 412 around second ends 205.

Figure 4D:
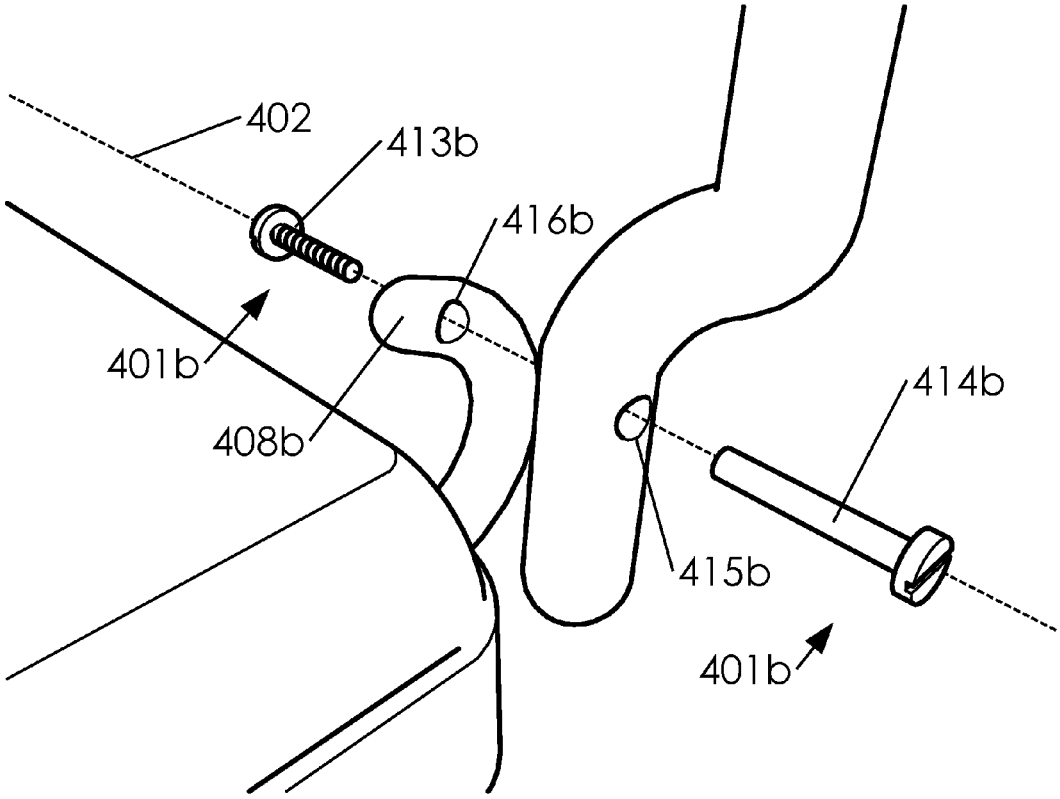
FIGS. 4D and 4E illustrate a front perspective exploded view of screw assemblies.
Figure 4E:
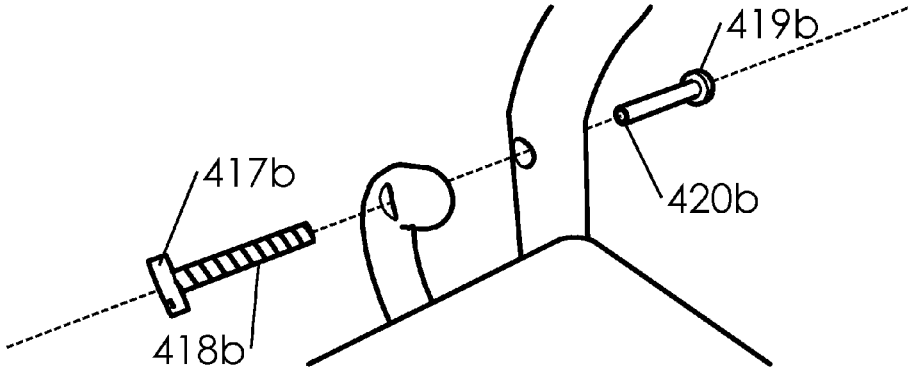

FIGS. 4D and 4E illustrate a front perspective exploded view of screw assemblies 401. Screw assembly 401 can each comprise a first portion 413 and a second portion 414. First end 306 of each of arms 103 can comprise an eye 415. Each of second end 408 can comprise an eye 416. In one embodiment, screw assembly 401 can hold each first end 306 of arms 103 to each hinge extender 310 of seat portion 101. In one embodiment, first portion 413 can each comprise a first end cap 417 and a male threaded portion 418. In one embodiment, second portion 414 can each comprise a second end cap 419 and a female threaded portion 420. In one embodiment, arms 103 can attach to seat portion 101 by: inserting second portion 414 through eye 415 and eye 416, inserting male threaded portion 418 into female threaded portion 420, rotating first portion 413 into second portion 414, and holding a portion of second end 408 and first end 306 between first end cap 417 and second end cap 419.

Figure 5:
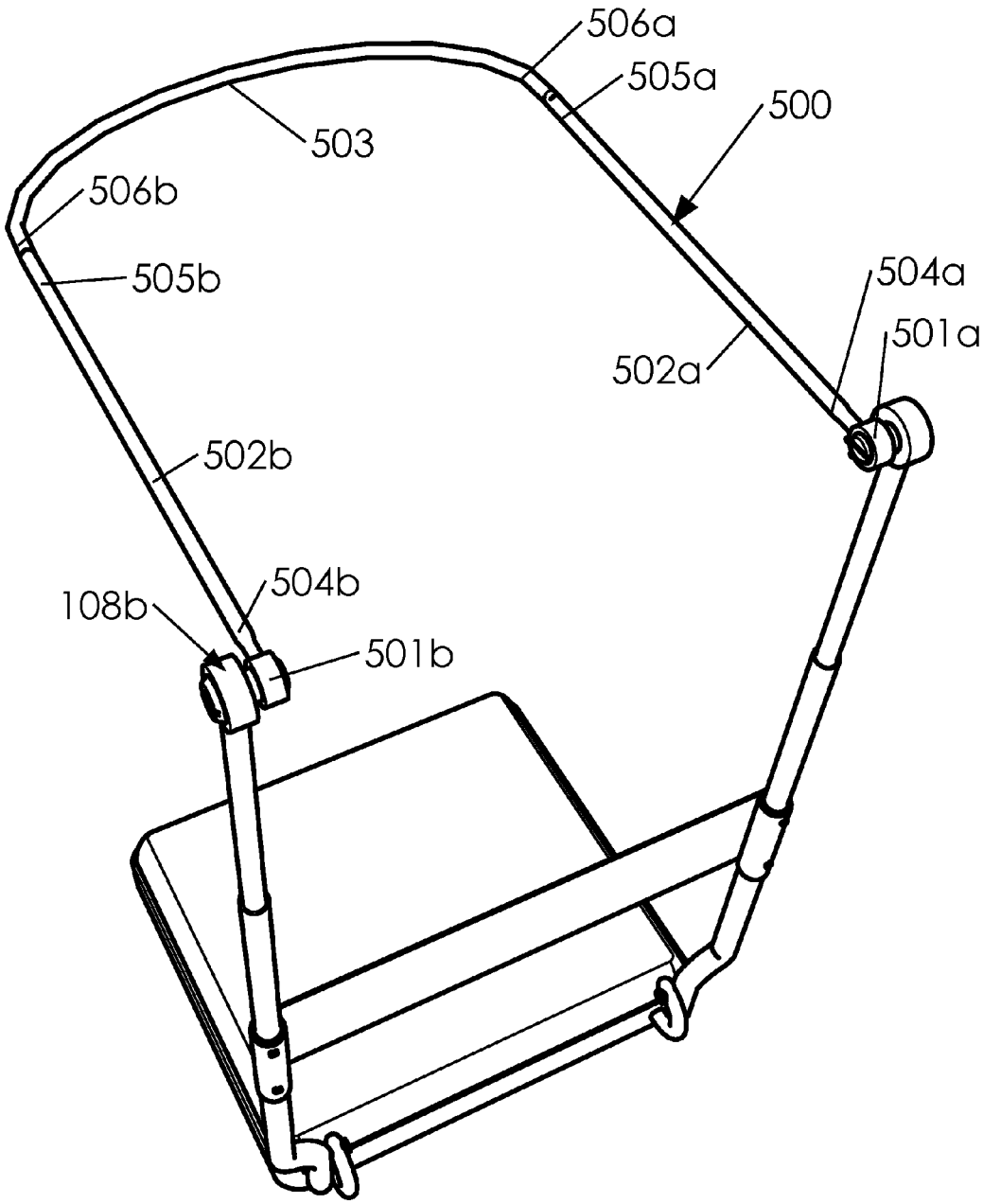
FIG. 5 illustrates a top rear perspective view of a shelter frame with arms and seat portion.

FIG. 5 illustrates a top rear perspective view of a shelter frame 500 with arms 103 and seat portion 101. Shelter portion 102 can comprise shelter frame 500. In one embodiment, shelter frame 500 can provide support and form to shelter portion 102. In one embodiment, top 107 can comprise a canvas material. In one embodiment, top 107 can wrap around and over shelter frame 500.

In one embodiment, each of rotating assemblies 108 can comprise a barrel hinge comprising one or more sectional barrels secured by a pivot. In one embodiment, shelter frame 500 can comprise a first sectional barrel 501*a* and a second sectional barrel 501*b* each comprising one of said sectional barrels of rotating assemblies 108. In one embodiment, each of rotating assemblies 108 can comprise a sectional barrel 501.

Shelter frame 500 can comprise two side portions 502 and a front portion 503. In one embodiment, shelter frame 500 can comprise a substantially round cross-section. Side portions 502 can comprise a first side portion 502*a* and a second side portion 502*b*. Side portions 502 can each comprise a first end 504 and a second end 505. First side portion 502*a* can comprise a first end 504*a* and a second end 505*a*. Second side portion 502*b* can comprise a first end 504*b* and a second end 505*b*. Front portion 503 can comprise a first end 506*a* and a second end 506*b*. In one embodiment, first sectional barrel 501*a* attaches to first end 504*a*, second end 505*a* attaches to first end 506*a*, second end 506*b* attaches to second end 505*b*, and first end 504*b* attaches to second sectional barrel 501*b*. In one embodiment, side portions 502 and front portion 503 can comprise a substantially U-shape.

Figure 6:
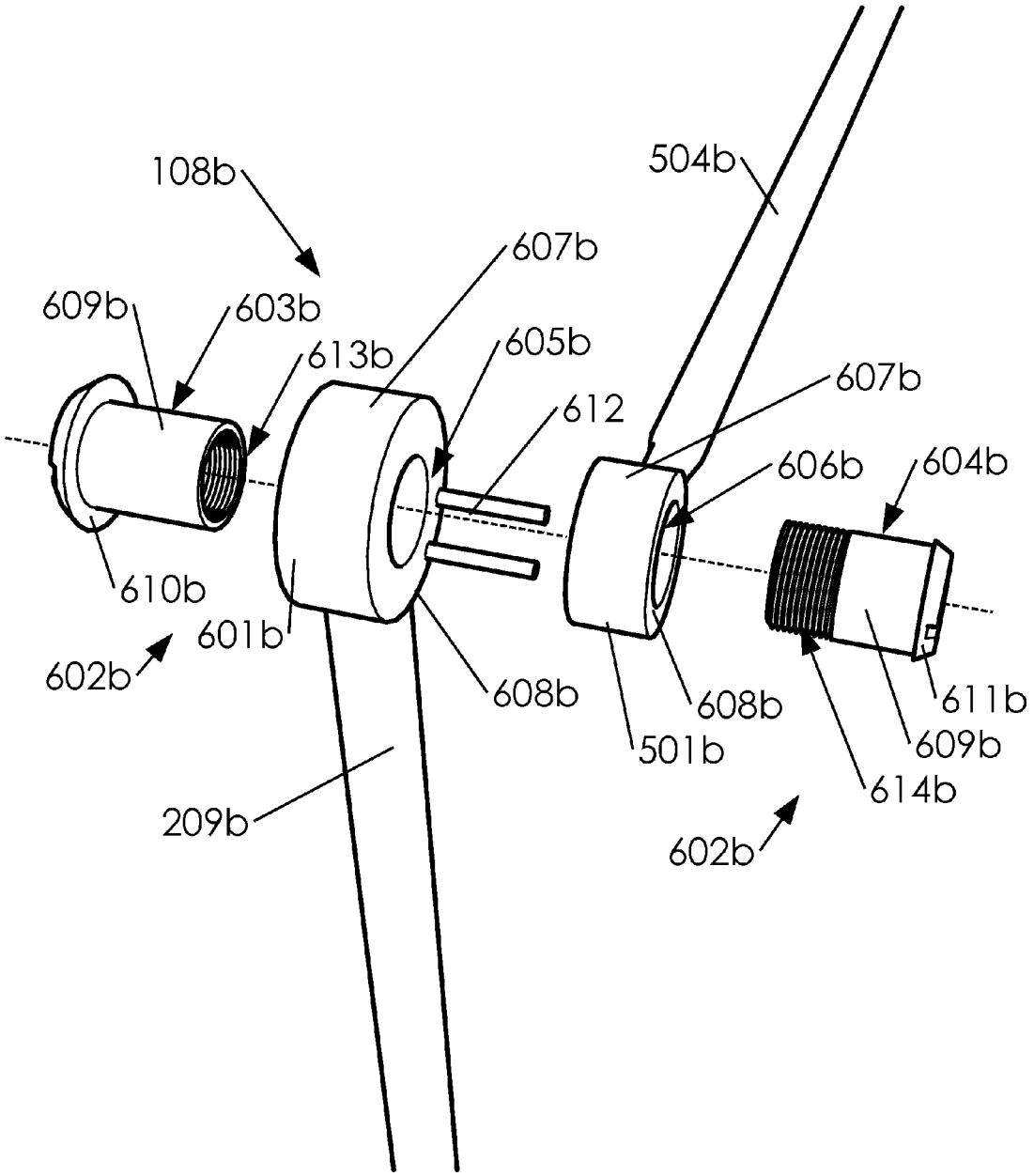
FIG. 6 illustrates a rear perspective exploded view of rotating assembly.

FIG. 6 illustrates a rear perspective exploded view of rotating assembly 108*b*. In one embodiment, each of rotating assemblies 108 can comprise a sectional barrel 501, a sectional barrel 601 and a pivot 602. Pivot 602 can comprise a first pivot 602*a* and a second pivot 602*b*. Each of pivots 602 can comprise a first portion 603 and a second portion 604. Each of sectional barrels 601 can comprise an eye 605. Each of sectional barrels 501 can comprise an eye 606. In one embodiment, the term "barrel" can comprise a component of a hinge that has a hollow cylinder shaped section where the rotational bearing force is applied to pivot 602, and may also have a screw shaped section for fastening and/or driving pivot 602. In one embodiment, eye 605 and eye 606 can comprise said hollow cylinder shaped section of said barrel. In one embodiment, sectional barrel 501 and sectional barrel 601 can comprise a cylindrical cross-section having a rounded external portion 607 and a two flat side portions 608.

In one embodiment, pivot 602 can comprise a cylindrical body 609, a first end cap 610, a second end cap 611, and a central axis 612. In one embodiment, sectional barrels 501 and sectional barrels 601 can rotate on central axis 612 by inserting pivot 602 through eye 605 and eye 606 and holding sectional barrel 601 and sectional barrel 501 between first end cap 610 and second end cap 611. In one embodiment, first portion 603 can comprise a female threaded portion 613, and second portion 604 can comprise a male threaded portion 614. In one embodiment, holding sectional barrel 601 and sectional barrel 501 can comprise: inserting first portion 603 through eye 605, inserting second portion 604 through eye 606, inserting male threaded portion 614 into female threaded portion 613, and screwing male threaded portion 614 into female threaded portion 613 until secure.

Figure 7A:
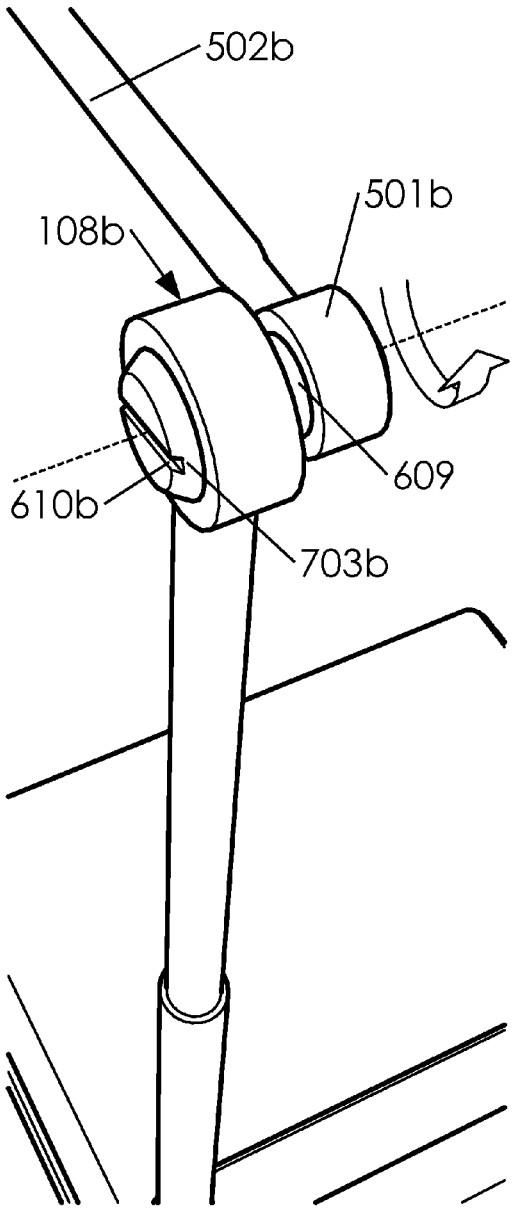
FIGS. 7A and 7B illustrate a second side perspective view and a first side perspective view of first end cap and second end cap.
Figure 7B:
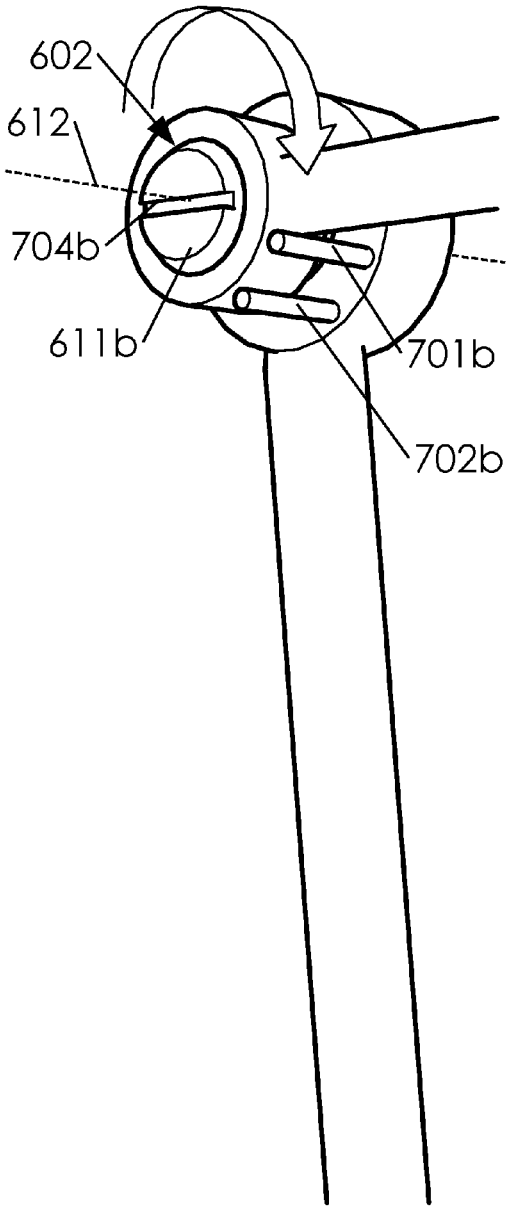

FIGS. 7A and 7B illustrate a second side perspective view and a first side perspective view of first end cap 610 and second end cap 611. Rotating assemblies 108 can comprise a first stopper 701 and a second stopper 702. In one embodiment, shelter frame 500 can rotate upon pivot 602 relative to sectional barrels 601 on central axis 612 with sectional barrels 501. In one embodiment, each of first end caps 610 can comprise a slot 703. In one embodiment, each of second end cap 611 can comprise a slot 704. In one embodiment, opposing rotary forces can be allied to second portion 604 and first portion 603 as male threaded portion 614 is screwed into female threaded portion 613 by inserting a driving instrument (such as screw drivers) into slot 703 and slot 704.

Figure 8A:
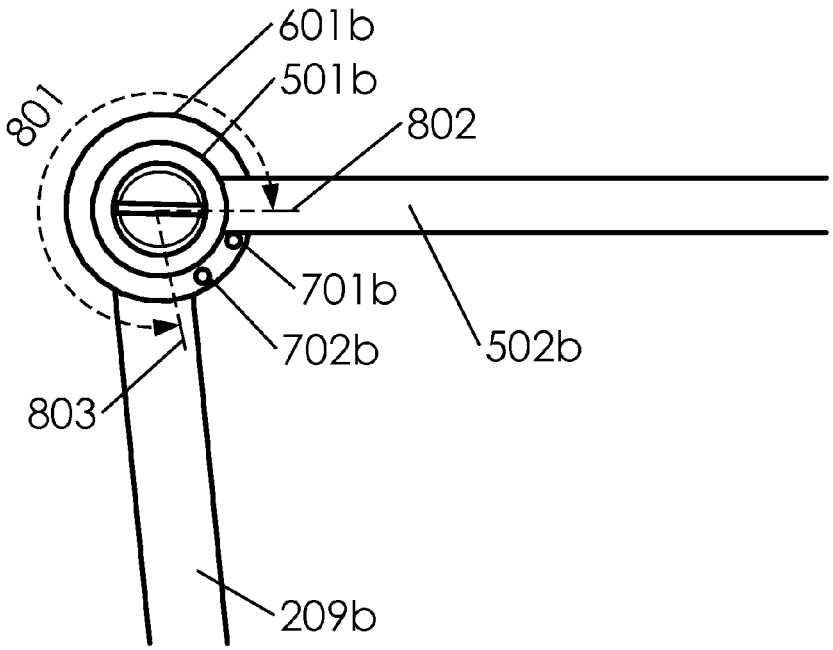
FIGS. 8A and 8B illustrate a first side elevated view of second side portion in an open position and a closed position, respectively.
Figure 8B:
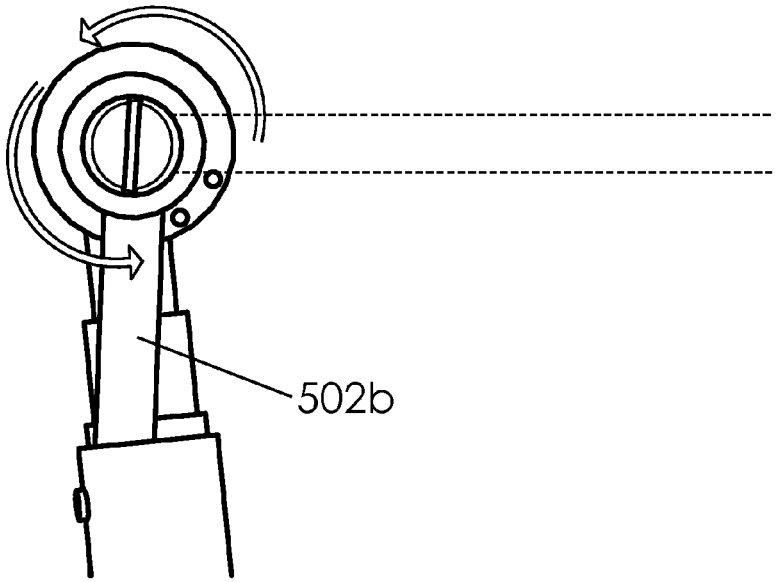

FIGS. 8A and 8B illustrate a first side elevated view of second side portion 502*b* in an open position and a closed position, respectively. Shelter portion 102 can comprise said open position and said closed position; wherein, said open position can comprise shelter portion 102 rotated above user 111 of personal weather shelter 100, and said closed position can comprise shelter portion 102 prepared for storage and transport (discussed infra). In one embodiment, sectional barrel 501 can rotate on central axis 612, relative to sectional barrel 601, through an angular range 801 between a first position 802 and a second position 803. In one embodiment, first position 802 can comprise a position of side portions 502 pressed against first stopper 701. In one embodiment, second position 803 can comprise a position of side portions 502 pressed against second stopper 702.

Figure 9A:
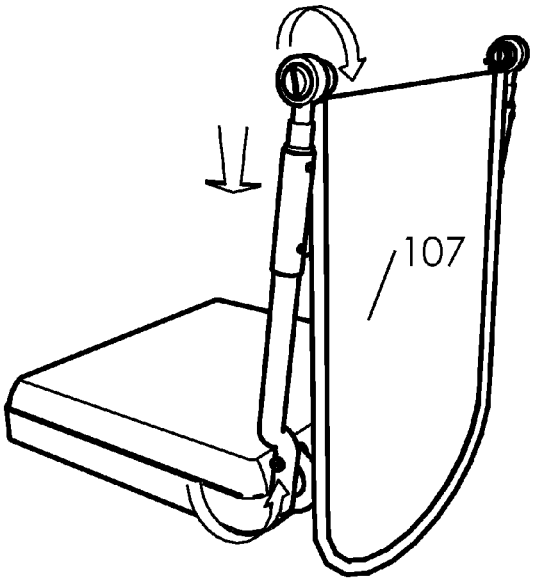
FIGS. 9A and 9B illustrate personal weather shelter transitioning between an open configuration and a closed configuration.
Figure 9B:
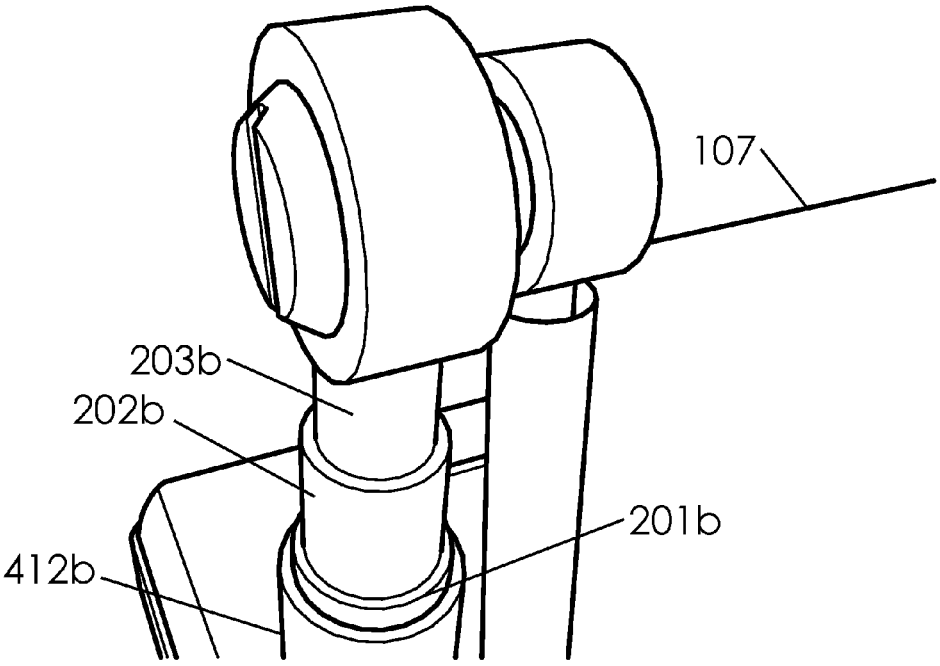

FIGS. 9A and 9B illustrate personal weather shelter 100 transitioning between an open configuration and a closed configuration. In one embodiment, transitioning between said open configuration and said closed configuration can comprise: rotating shelter portion 102 from said open position to said closed position, contracting said arms 103 from said extended configuration to said contracted configuration, and rotating said arms 103 from open position 404 to closed position 405.

In one embodiment, personal weather shelter 100 can be used with shelter portion 102 in said closed position. For example, rotating shelter portion 102 into said closed position may provide shade where a light source is behind user 111. In one embodiment, personal weather shelter 100 can further be used with shelter portion 102 in said closed position and arms 103 in said contracted configuration. For example, in one embodiment, personal weather shelter 100 can be used where user 111 is not in need of shade or shelter, only comfort from seat portion 101 and seat back 106.

Figure 10A:
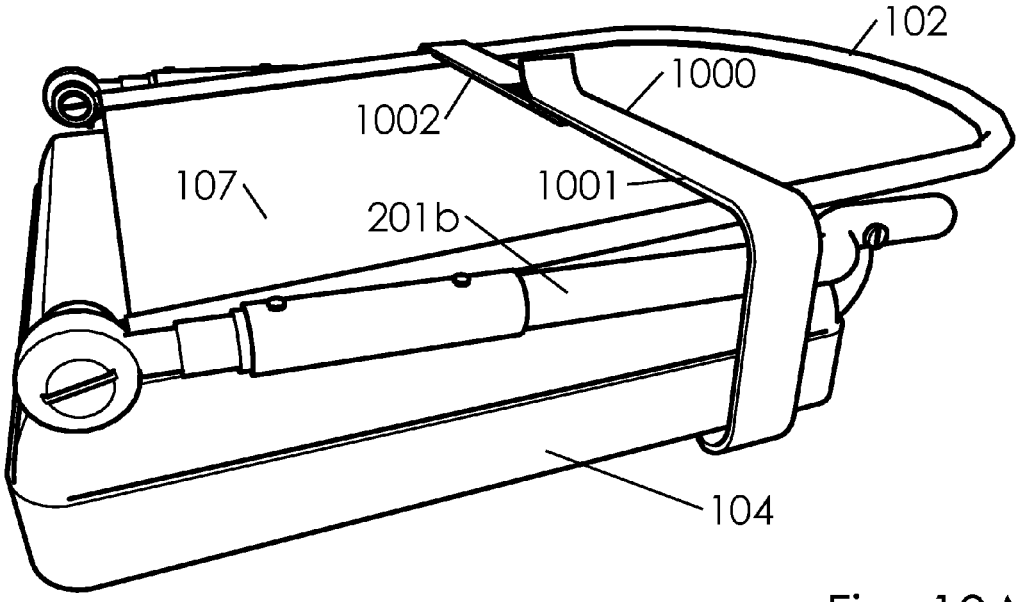
FIGS. 10A, 10B and 10C illustrate a rear first side perspective view, a top elevated view and second side elevated view of personal weather shelter in said closed configuration.
Figure 10B:
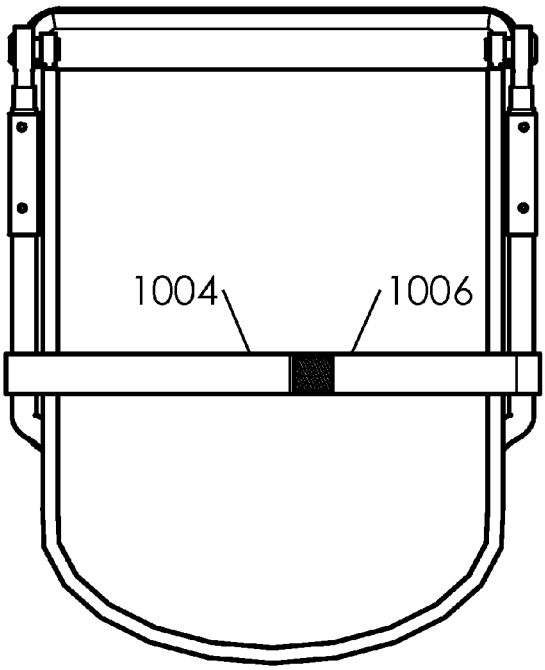
Figure 10C:
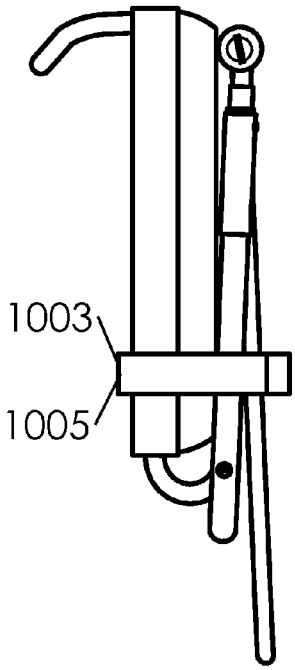

FIGS. 10A, 10B and 10C illustrate a rear first side perspective view, a top elevated view and second side elevated view of personal weather shelter 100 in said closed configuration. In one embodiment, personal weather shelter 100 can fold up for easy transportation in said closed configuration. In one embodiment, personal weather shelter 100 can easily expand into said open configuration for use. In one embodiment, grip 109 can be used as a handle for carrying personal weather shelter 100 in said closed configuration. In one embodiment, personal weather shelter 100 can further comprise one or more straps 1000 to hold it in said closed configuration by wrapping said straps 1000 around seat portion 101, shelter portion 102, and arms 103. Strap 1000 can comprise a first strap 1001 and a second strap 1002. First strap 1001 can comprise a first end 1003 and a second end 1004. Second strap 1002 can comprise a first end 1005 and a second end 1006. In one embodiment, straps 1000 are capable of holding personal weather shelter 100 in said closed configuration by: securing first end 1003 and first end 1005 to bottom 217 of seat portion 101; wrapping second end 1004 around first side 303*a*, first arm 103*a*, and a portion of shelter portion 102; wrapping second end 1006 around second side 303*b*, second arm 103*b*, and a portion of shelter portion 102; and securing first end 1003 to first end 1005.

Figure 10D:
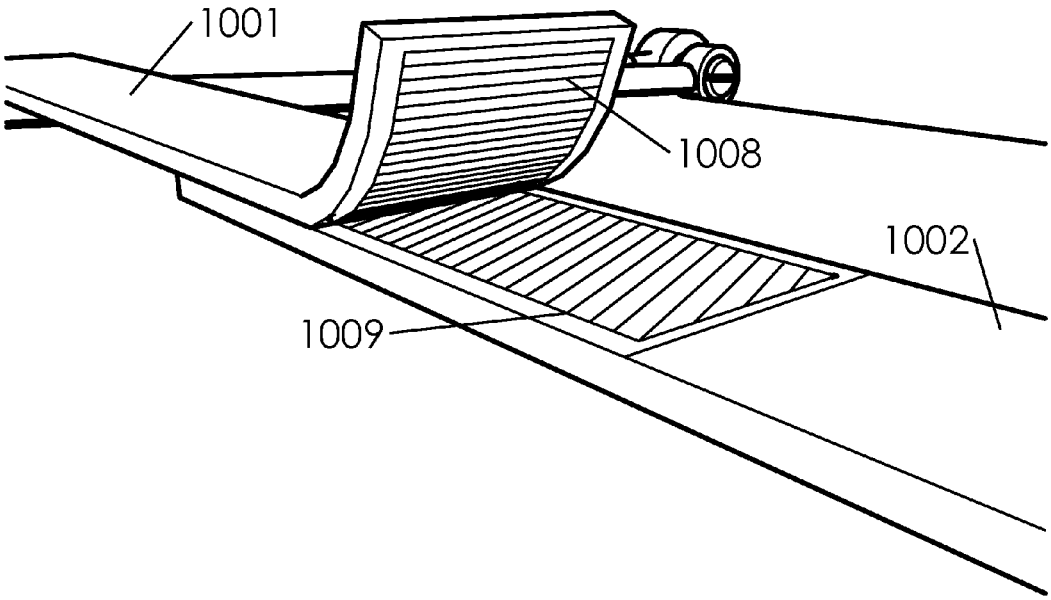
FIG. 10D illustrates a top perspective view of strap.

FIG. 10D illustrates a top perspective view of strap 1000. In one embodiment, strap 1000 can comprise a set of hook-and-loop fasteners comprising a first portion 1008 and a second portion 1009. In one embodiment, first portion 1008 can attach to a bottom side of second end 1004, second portion 1009 can attach to a top side of second end 1006. In one embodiment, securing first end 1003 to first end 1005 can comprise pressing first portion 1008 against second portion 1009.

Figure 11:
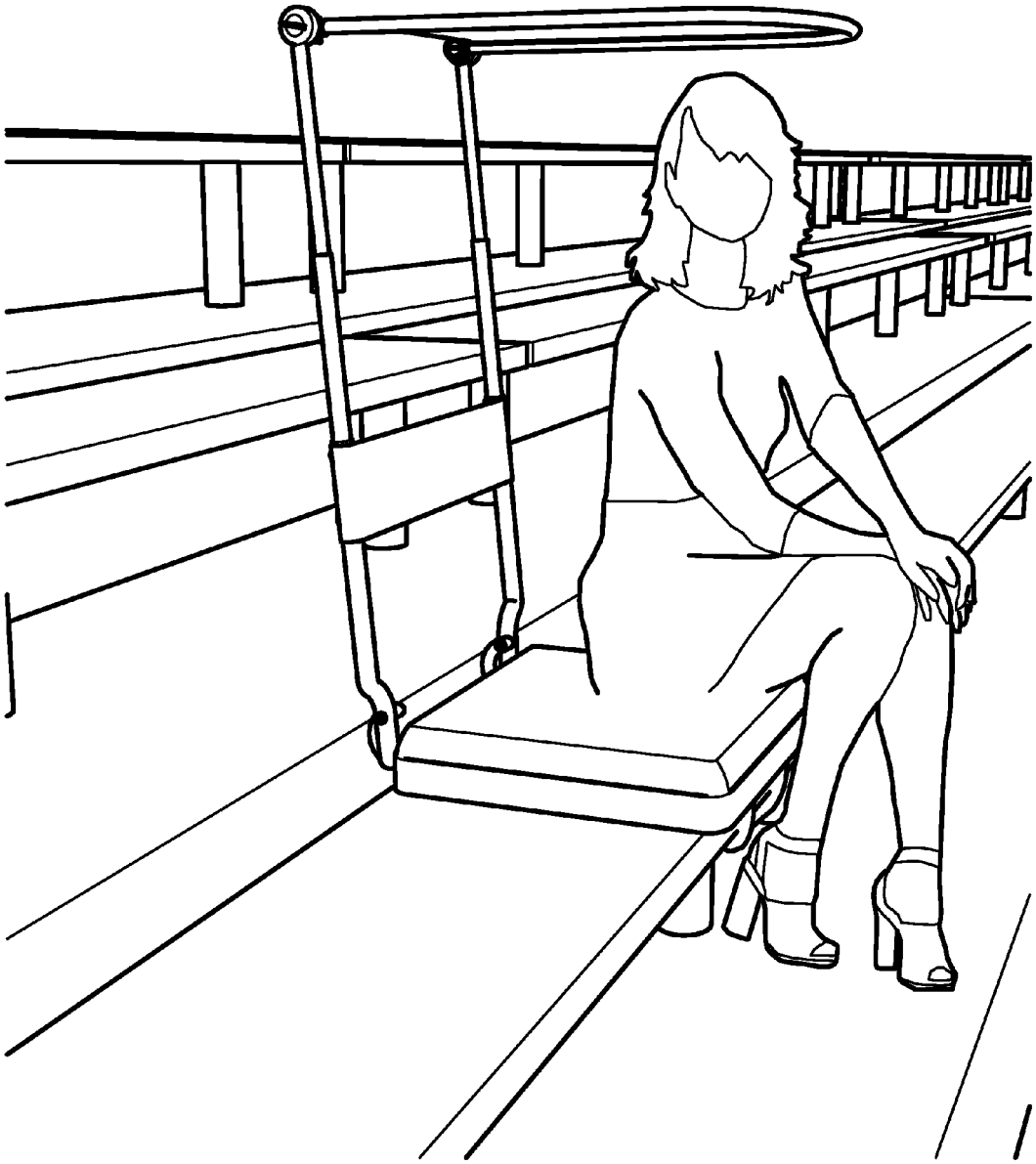
FIG. 11 illustrates personal weather shelter in said open configuration and in use.

FIG. 11 illustrates personal weather shelter 100 in said open configuration and in use. In one embodiment, personal weather shelter 100 can provide shade and shelter from sun, rain, wind, snow, sleet, or similar to user 111.

Figure 12:
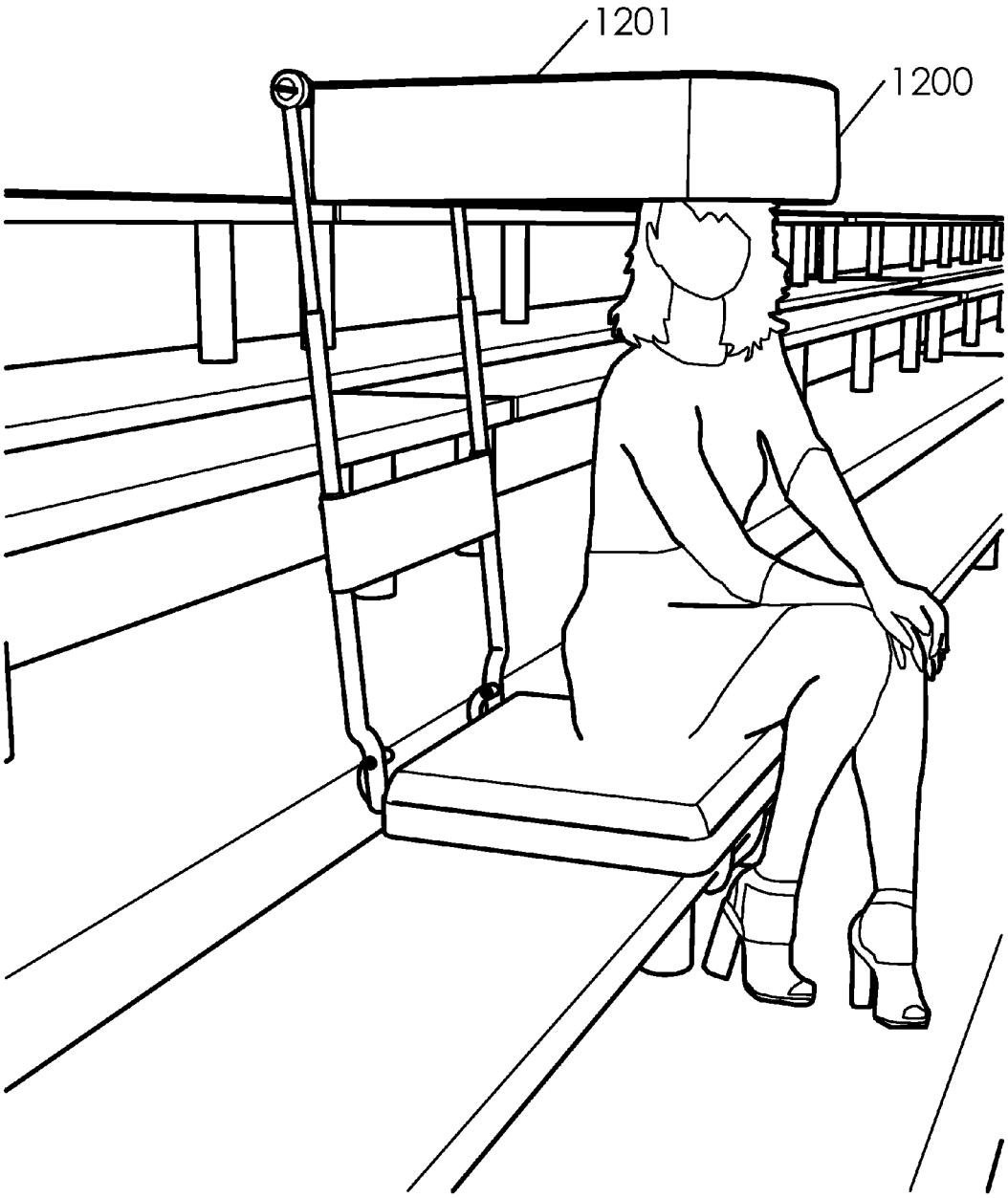
FIG. 12 illustrates personal weather shelter with a curtain.

FIG. 12 illustrates personal weather shelter 100 with a curtain 1200. In one embodiment, top 107 of shelter portion 102 can comprise a curtain 1200. In one embodiment, curtain 1200 can drape over shelter portion 102 and hang down around user 111. In one embodiment, curtain 1200 can attach to a side portion of shelter portion 102 with an attaching means such as a set of hook-and-loop fasteners 1201, buttons, or similar. In another embodiment, curtain 1200 can comprise a portion of top 107 which folds up and when not in use or when personal weather shelter 100 is in said closed configuration.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A personal weather shelter comprising a seat portion, a shelter portion, one or more arms, one or more screw assemblies, and one or more rotating assemblies; wherein, said seat portion comprises a base, a seat back, a front, a back, a first side, a second side, a top and a bottom;

said first side and said second side can each comprise a front end and a back end;

said arms each comprise a first end and a second end;

said first ends of said arms each attach to said seat portion with said screw assemblies;

said arms are each capable of rotating on said screw assemblies relative to said seat portion;

said second ends of said arms each attach to said shelter portion with said rotating assemblies;

said shelter portion is capable of rotating on said rotating assemblies relative to said arms;

said personal weather shelter is capable of transitioning between an open configuration and a closed configuration by rotating arms about screw assemblies and shelter portion about rotating assemblies; and further comprising two hinge extenders; wherein:

said hinge extenders each comprise a first end and a second end;

said hinge extenders comprise a first extender and a second extender;

said first extender attaches to a first side of said back of said seat portion;

said second extender attaches to a second side of said back of said seat portion;

said second ends of said hinge extenders each comprise an eye;

said first end of each of said arms comprise an eye;

said screw assemblies each comprise a first portion and a second portion;

said first portion of said screw assemblies comprises a first end cap and a male threaded portion;

said second portion of said screw assemblies comprises a second end cap and a female threaded portion; and said arms can each attach to said seat portion by inserting said second portion through said eye of said arms and then through said eye of said hinge extenders, inserting said male threaded portion of said screw assembly into said female threaded portion of said screw assembly, rotating said first portion into said second portion of said screw assembly, and holding a portion of said first end of said arms and said second ends of said hinge extenders between said first end cap and said second end cap of said screw assemblies.

2. The personal weather shelter of claim 1 wherein said arms comprise a plurality of telescoping portions having a cylindrical cross-section, and said plurality of telescoping portions are capable of extending and contracting within one another to an extended configuration and a contracted configuration.

3. The personal weather shelter of claim 2 wherein said extend configuration comprises said plurality of telescoping portions extending to a maximum length; and said contracted configuration comprises said plurality of telescoping portions contracting to a minimum length.

4. The personal weather shelter of claim 2 wherein:

said plurality of telescoping portions of each of said arms each comprise a first portion, a second portion, and a third portion;

said first portions comprise a first end and a second end;

said second portions comprise a first end and a second end;

said third portions comprise a first end and a second end;

said first ends of said first portions attach to said screw assemblies;

said first portions comprise an external cylinder of said telescoping portions capable of receiving said second portions;

said third portion can comprise an internal cylinder of said telescoping portions;

said second portions slide in and out of said first portions; and said third portions slide in and out of said second portions.

5. The personal weather shelter of claim 1 wherein said arms comprise a first arm and a second arm, said first arm attaches to said first side of said seat portion with a first screw assembly, and said second arm attaches to said second side of said seat portion with a second screw assembly.

6. The personal weather shelter of claim 5 wherein said seat back comprises a middle portion and two end portions;

said end portions comprise a first end portion and a second end portion;

said first end portion attaches to said first arm and said second end portion attaches to said second arm; and said middle portion extends between said arms and is capable of providing back support to a user of said personal weather shelter.

7. The personal weather shelter of claim 6 wherein said end portions of said seat back attach to said arms by wrapping around said arms and securing said end portions to said arms with a plurality of pins.

8. The personal weather shelter of claim 1 wherein said seat portion comprises a seat cushion on top of said base; further wherein, said base is capable of stacking on a stadium bench and said seat cushion is capable of supporting a user of said personal weather shelter sitting upon said seat portion.

9. The personal weather shelter of claim 1 wherein said seat portion further comprises a grip capable of holding said personal weather shelter on a stadium bench by stacking said base of said seat portion on said stadium bench, wrapping grip around a front portion of said stadium bench, and preventing personal weather shelter from sliding backward on said personal weather shelter when a user sits on said personal weather shelter.

10. The personal weather shelter of claim 1 wherein said screw assemblies comprise a central axis, and said arms rotate relative to said seat portion about said central axis on said screw assemblies.

11. The personal weather shelter of claim 10 wherein said arms are capable of rotating on said screw assemblies relative to said seat portion through a range of positions comprising an open position and a closed position; and said arms each comprise a lower portion below said eye of said arms; further wherein, rotating said arms into said open position comprises rotating said arms relative to said seat portion until said lower portions of said arms press into said back of said seat portion, and rotating said arms into said closed position comprises rotating said arms relative to said seat portion until a portion of said arms press into said seat portion.

12. The personal weather shelter of claim 1 wherein said shelter portion further comprises a curtain; and said curtain attaches about a perimeter of said shelter portion and hangs down around a user of said personal weather shelter.

13. The personal weather shelter of claim 1 wherein said open configuration comprises said arms in an extended configuration, said rotating assemblies rotated into an open position, and said screw assembly rotated into an open position; and, said closed configuration comprises said arms in an contracted configuration, said rotating assemblies rotated into a closed position, and said screw assembly rotated into a closed position.

14. The personal weather shelter of claim 13 further comprising a strap, wherein said arms comprise a first arm and a second arm;

said straps comprise a first strap and a second strap;

each of said first strap and said second strap comprise a first end and a second end; and, said straps are capable of holding said personal weather shelter in said closed configuration by:

securing said first end of said first strap to said bottom of said seat portion;

securing said first end of said second strap to said bottom of said seat portion;

wrapping said second end of said first strap around said first side of said seat portion, said first arm, and a portion of said shelter portion;

wrapping said second end of said second strap around said second side of said seat portion, said second arm, and a portion of said shelter portion; and securing said second end of said first strap to said second end of said second strap.

15. A personal weather shelter comprising a seat portion, a shelter portion, one or more arms, one or more screw assemblies, and one or more rotating assemblies; wherein, said seat portion comprises a base, a seat back, a front, a back, a first side, a second side, a top and a bottom;

said first side and said second side can each comprise a front end and a back end;

said arms each comprise a first end and a second end;

said first ends of said arms each attach to said seat portion with said screw assemblies;

said arms are each capable of rotating on said screw assemblies relative to said seat portion;

said second ends of said arms each attach to said shelter portion with said rotating assemblies;

said shelter portion is capable of rotating on said rotating assemblies relative to said arms;

said personal weather shelter is capable of transitioning between an open configuration and a closed configuration by rotating arms about screw assemblies and shelter portion about rotating assemblies;

said seat portion further comprises a grip capable of holding said personal weather shelter on a stadium bench by stacking said base of said seat portion on said stadium bench, wrapping grip around a front portion of said stadium bench, preventing personal weather shelter from sliding backward on said personal weather shelter when a user sits on said personal weather shelter;

said shelter portion comprises a shelter frame and a top;

said shelter frame attaches to said rotating assemblies;

said top wraps around and over said shelter frame;

said shelter frame comprises two side portions and a front portion;

said side portions comprise a first side portion and a second side portion;

each of said side portions comprise a first end and a second end;

said front portion comprises a first end and a second end;

said second end of said first side portion attaches to said first end of said front portion;

said second end of said second side portion attaches to said second end of said front portion;

said first ends of said side portions attach to said rotating assemblies;

said rotating assemblies attach to said second ends of said arms;

said arms comprise a first arm and a second arm;

said rotating assemblies each comprise a barrel hinge having one or more sectional barrels secured by a pivot;

said first ends of said side portions each comprise a sectional barrel;

said second ends of said arms each comprise a sectional barrel;

said sectional barrel of said first side portion is secured to said sectional barrel of said first arm with a first pivot;

said section barrel of said second side portion is secured to said section barrel of said second arm with a second pivot;

said pivots each comprise a first portion and a second portion;

said first portion of said pivots comprise a first end cap at one end and a female threaded portion at another end;

said second portion of said pivots comprise a second end cap at one end and a male threaded portion at another end;

said sectional barrels each comprise an eye;

said eyes comprise a hollow cylinder capable of receiving said pivots; and said first portions of each of said pivots attach to said second portions of each of said pivots by screwing said male threaded portion into said female threaded portion; and said pivots hold said section barrels between said first end cap and said second end cap by inserting said first portion through said section barrels, inserting said second portion through another end of said section barrels, and attaching said first portion to said second portion.

16. A personal weather shelter comprising a seat portion, a shelter portion, one or more arms, one or more screw assemblies, and one or more rotating assemblies; wherein, said seat portion comprises a base, a seat back, a front, a back, a first side, a second side, a top and a bottom;

said first side and said second side can each comprise a front end and a back end;

said arms each comprise a first end and a second end;

said first ends of said arms each attach to said seat portion with said screw assemblies;

said arms are each capable of rotating on said screw assemblies relative to said seat portion;

said second ends of said arms each attach to said shelter portion with said rotating assemblies;

said shelter portion is capable of rotating on said rotating assemblies relative to said arms;

said personal weather shelter is capable of transitioning between an open configuration and a closed configuration by rotating arms about screw assemblies and shelter portion about rotating assemblies;

said seat portion further comprises a grip capable of holding said personal weather shelter on a stadium bench by stacking said base of said seat portion on said stadium bench, wrapping grip around a front portion of said stadium bench, preventing personal weather shelter from sliding backward on said personal weather shelter when a user sits on said personal weather shelter;

said shelter portion comprises a shelter frame and a top;

said shelter frame attaches to said rotating assemblies;

said top wraps around and over said shelter frame;

said shelter frame comprises two side portions and a front portion;

said side portions comprise a first side portion and a second side portion;

each of said side portions comprise a first end and a second end;

said front portion comprises a first end and a second end;

said second end of said first side portion attaches to said first end of said front portion;

said second end of said second side portion attaches to said second end of said front portion;

said first ends of said side portions attach to said rotating assemblies;

said rotating assemblies attach to said second ends of said arms;

said arms comprise a first arm and a second arm;

said rotating assemblies each comprise a barrel hinge having one or more sectional barrels secured by a pivot;

said first ends of said side portions each comprise a sectional barrel;

said second ends of said arms each comprise a sectional barrel;

said sectional barrel of said first side portion is secured to said sectional barrel of said first arm with a first pivot;

said section barrel of said second side portion is secured to said section barrel of said second arm with a second pivot;

said shelter frame can rotate on said rotating assemblies through an angular range relative to said arms; further wherein, said angular range comprises a first position and a second position;

said first position comprises a position of said shelter frame pressed against a first stopper on said section barrel of said second ends of said arms;

said second position comprise a position of said shelter frame pressed against a second stopper on said section barrel of said second ends of said arms;

said first position comprises said shelter portion in an open position rotated above a user of said personal weather shelter; and said second position comprises said shelter portion in a closed position rotated back and prepared for storage and transport.

* * * * *